US005824623A

United States Patent [19]

Kawai et al.

[11] Patent Number: 5,824,623

[45] Date of Patent: Oct. 20, 1998

[54] THERMAL TRANSFER IMAGE-RECEIVING SHEET

[75] Inventors: Satoru Kawai; Masayasu Yamazaki; Kenichiro Sudo; Hitoshi Saito, all of Tokyo-To, Japan

[73] Assignee: Dai Nippon Printing Co., Ltd., Japan

[21] Appl. No.: 672,593

[22] Filed: Jun. 28, 1996

[30] Foreign Application Priority Data

Jun. 30, 1995 [JP] Japan ..... 7-186595

[51] Int. Cl.[6] ..... B41M 5/035; B41M 5/38

[52] U.S. Cl. ..... 503/227; 428/195; 428/341; 428/522; 428/913; 428/914

[58] Field of Search ..... 8/471; 428/195, 428/522, 913, 914, 323, 341; 503/227

[56] References Cited

U.S. PATENT DOCUMENTS

| | | | |
|---|---|---|---|
| 4,689,274 | 8/1987 | Yamahata | 428/522 |
| 5,270,283 | 12/1993 | Koshizuka et al. | 503/227 |
| 5,283,220 | 2/1994 | Kawaguchi et al. | 503/200 |

FOREIGN PATENT DOCUMENTS

| | | | |
|---|---|---|---|
| 474355 | 3/1992 | European Pat. Off. | 503/227 |
| 505993 | 8/1992 | European Pat. Off. | 503/227 |
| 698500 | 2/1996 | European Pat. Off. | 503/227 |
| 61-266296 | 11/1986 | Japan | 503/227 |
| 63-54284 | 3/1988 | Japan | 503/227 |
| 2-244147 | 9/1990 | Japan | 503/227 |

*Primary Examiner*—Bruce H. Hess
*Attorney, Agent, or Firm*—Parkhurst & Wendel

[57] ABSTRACT

There is provided a thermal transfer image-receiving sheet comprising: a substrate sheet; and an image-receiving layer provided on one side of the substrate sheet, the image-receiving layer comprising a copolymer, having an average degree of polymerization of 800 to 2000, of at least vinyl chloride and vinyl acetate as main comonomers.

6 Claims, No Drawings

THERMAL TRANSFER IMAGE-RECEIVING SHEET

BACKGROUND OF THE INVENTION

1. Field of the Invention

This invention relates to a thermal transfer image-receiving sheet which, in use, is laminated onto a thermal transfer sheet. More particularly, this invention relates to a thermal transfer image-receiving sheet which can provide a very sharp, highly transparent image independently of environmental conditions such as temperature and humidity.

2. Background Art

Various thermal transfer recording systems are known in the art. Among them, a thermal dye transfer system, wherein a thermal transfer sheet comprising a support, such as a polyester film, bearing a thermal transfer layer containing a sublimable dye is heated by means of heating medium, such as a thermal head or a laser beam, to form an image on a recording medium, have recently drawn attention and utilized as information recording means in various fields.

This thermal dye transfer system can form, in very short time, a full-color image having excellent halftone reproduction and gradation and a quality comparable to that of full-color photographic images.

Further, according to this system, since a resin constituting the image-receiving layer is dyed with a dye to form an image, the formed image advantageously has high sharpness and excellent transparency and, hence, has been extensively used in the preparation of transparent originals for projectors, such as overhead projectors (hereinafter abbreviated to "OHP").

The conventional image-receiving sheet for OHP comprises an about 100 $\mu$m-thick transparent substrate sheet of polyethylene terephthalate (hereinafter often abbreviated to "PET") bearing an image-receiving layer on one side thereof and a back side layer on the other side thereof.

The image-receiving layer functions to receive a sublimable dye being transferred from a thermal transfer sheet and to hold the formed image and is formed of a thermoplastic resin, for example, a saturated polyester resin, a vinyl chloride/vinyl acetate copolymer, or a polycarbonate resin. If necessary, an intermediate layer is provided on the image-receiving layer side of the substrate.

For example, a layer for imparting a cushioning property in the case of a highly rigid substrate, such as PET, and a layer for imparting an antistatic property are optionally provided as the intermediate layer.

The back side layer functions to prevent curling and to improve the slipperliness of the image-receiving sheet and is formed by coating a composition containing a binder, such as an acrylic resin, with an organic filler, such as a fluororesin or a polyamide rein, or an inorganic filler, such as silica, incorporated therein.

On the other hand, in the case of the so-called "standard type thermal transfer image-receiving sheet," the image-receiving sheet is viewed or used by taking advantage of reflected light rather than transmitted light. The construction of this standard type thermal transfer image-receiving sheet is substantially the same as that of the above thermal transfer image-receiving sheet, except that, the substrate is constituted by an opaque material, for example, white PET, foamed PET, other plastic sheet, natural paper, synthetic paper, or a laminate thereof.

Some vinyl chloride/vinyl acetate copolymer resins having a relatively low degree of polymerization have hitherto been used as one of resins for image-receiving layer of the conventional thermal transfer image-receiving sheet and offered good printing performance. Commercially available vinyl chloride/vinyl acetate copolymer resins for such applications include, for example, resins available under the trade name designations S-lec A, S-lec C, and S-lec M (manufactured by Sekisui Chemical Co., Ltd.), Vinylight VYHH, Vinylight VYHD, Vinylight VYNS, Vinylight VMCH, Vinylight VMCC, Vinylight VMCA, Vinylight VAGH, and Vinylight VAGD (manufactured by Union Carbide Corporation, U.S.A.), and Denka Vinyl #1000 AKT, Denka Vinyl #1000 AS, Denka Vinyl #1000 MT, Denka Vinyl #1000 MT2, Denka Vinyl #1000 GK, Denka Vinyl #1000 GKT, Denka Vinyl #1000 CS, Denka Vinyl #1000 CSK, Denka Vinyl #1000 LT3, and Denka Vinyl #1000 D (manufactured by Denki Kagaku Kogyo K.K.). These resins have an average degree of polymerization of about 200 to 700. Such vinyl chloride/vinyl acetate copolymer resins having a relatively low degree of polymerization can be easily dissolved in an organic solvent, and, by virtue of this feature, have been used in various applications including base resins of adhesives and paints. Further, since such resins have suitable receptivity to dyes, they, either alone or as a mixture thereof with a polyester resin are, in many cases, used as a base resin of an image-receiving layer in an image-receiving sheet used with a thermal dye transfer sheet. However, the conventional thermal transfer image-receiving sheets using the above vinyl chloride/vinyl acetate copolymer resins having a relatively low degree of polymerization as the resin for constituting the image-receiving layer have the following problems.

For example, in the case of an image-receiving sheet for OHP, a high density is required of a transparent print in order to provide satisfactory dynamic range (three-dimensional effect and design) in the projection of the image, and, for this reason, considerable energy is applied to a high-density print area. The surface of the image-receiving layer is subjected to damage by the heat and consequently roughened. The roughening results in scattering of light which is transmitted or reflected at the time of projection through OHP, so that the projected image is blackish.

On the other hand, in the case of the standard type image-receiving sheet, light is unfavorably reflected from the roughened surface, posing problems including that only a part of the image becomes matte and the density of a portion where high energy has been applied in order to provide high density becomes low due to the roughening.

For the above reason, in the case of image-receiving sheets for OHP or of the standard type, satisfactory energy cannot be applied from the viewpoint of avoiding this problem of roughening, making it impossible to provide necessary density.

Furthermore, the conventional image-receiving sheets have the following problem associated with feed into a thermal transfer printer. Specifically, when a plurality of sheets of the image-receiving sheet are put on top of one another within a sheet cassette and fed one by one by means of a pickup roll into the printer, friction occurs between the back side layer of one sheet and the image-receiving surface of another sheet, causing the image-receiving surface to be scratched. This deteriorates the appearance of the sheet, and, in addition, at the time of printing, causes abnormal transfer, which is such an unfavorable phenomenon that the dye layer of the thermal transfer sheet, together with a binder, is transferred onto the surface of the image-receiving layer, or, at the time of projection of the image through OHP, causes the scratch as well as the image to be projected as a blackish image, making it impossible to provide a desired image.

When the substrate is made of a rigid material, such as PET, the problem of scratching often occurs not only at the time of feed of the image-receiving sheet into the printer, but also in the course of being carried within the printer due to friction between the sheet and an internal mechanism(s).

Furthermore, the conventional image-receiving sheet has an additional drawback that it is likely to be curled by heat or pressure applied at the time of printing by means of a thermal transfer printer, by heat from light source of OHP, or by the temperature of an environment under which the image-receiving sheet is stored.

Furthermore, during the preparation of the thermal transfer image-receiving sheet, static electricity created in the thermal transfer image-receiving sheet causes carrying troubles and deposition of dust. In addition, the static electricity poses a problem of carrying troubles within a thermal transfer printer, for example, double feed at the time of feed of the image-receiving sheet into the printer.

The present invention has been made with a view to solving the above problems of the prior art, and an object of the present invention is to provide a thermal transfer image-receiving sheet which can prevent roughening of the surface of the image-receiving layer in its high-energy printing area and creates no scratch in the image-receiving layer even in the case of friction between a plurality of sheets of the image-receiving sheet at the time of feed into a printer.

SUMMARY OF THE INVENTION

According to the present invention, the above object can be attained by a thermal transfer image-receiving sheet comprising: a substrate sheet; and an image-receiving layer provided on one side of the substrate sheet, the image-receiving layer comprising a copolymer, having an average degree of polymerization of 800 to 2000, of at least vinyl chloride and vinyl acetate as main comonomers. According to one preferred embodiment of the present invention, the coverage of the image-receiving layer is 0.5 to 4.0 g/m$^2$ on a dry weight basis. According to another preferred embodiment of the present invention, the thermal transfer image-receiving sheet further comprises a back side layer provided on the other side of the substrate sheet, the back side layer being formed of a composition comprising an acrylic polyol and fine particles of an organic material. According to a further preferred embodiment of the present invention, the thermal transfer image-receiving sheet further comprises an intermediate layer, having an antistatic property, between the substrate sheet and the image-receiving layer.

The substrate sheet is preferably a transparent sheet. Further, preferably, at least one side of the substrate sheet has been subjected to adhesiveness-improving treatment and/or antistatic treatment.

The present invention can realize a thermal transfer image-receiving sheet which can prevent roughening of the surface of the image-receiving layer in its high-energy printing area and, hence, can be used as an OHP sheet free from blackening of high-density area at the time of projection through OHP, and, in the case of the standard type image-receiving sheet, can prevent only a high-density area from becoming matte.

In the conventional thermal transfer image-receiving sheet, satisfactory energy cannot be applied in order to avoid blackening or matting of the image attributable to the roughening of the surface of the image-receiving layer, making it impossible to provide necessary image density. By contrast, according to the thermal transfer image-receiving sheet of the present invention, the application of satisfactory energy poses no matte problem, offering a contemplated good image. Further, the thermal transfer image-receiving sheet of the present invention can withstand friction between a plurality of sheets of the image-receiving sheet at the time of feed of the sheet into a printer, enabling scratching of the image-receiving layer to be prevented. Therefore, unlike the conventional thermal transfer image-receiving sheet, the thermal transfer image-receiving sheet of the present invention can avoid troubles such as abnormal transfer, caused by the presence of scratch, and has high reliability.

Further, the provision of an intermediate layer, having an antistatic property, between the image-receiving layer and the substrate sheet and antistatic treatment of the outermost surface of the thermal transfer image-receiving sheet can improve the carriability of the thermal transfer image-receiving sheet within a thermal transfer printer under any environment.

DETAILED DESCRIPTION OF THE INVENTION

The thermal transfer image-receiving sheet of the present invention will be described in detail.

<Substrate sheet>

The substrate sheet functions to support an image-receiving layer and, preferably, is not deformed by heat applied at the time of thermal transfer and has mechanical strength high enough to cause no trouble when handled in a printer or the like.

Materials for constituting the substrate sheet is not particularly limited, and examples thereof include films of various plastics, for example, polyesters, polyacrylates, polycarbonates, polyurethane, polyimides, polyetherimides, cellulose derivatives, polyethylene, ethylene/vinyl acetate copolymer, polypropylene, polystyrene, polyacrylonitrile, polyvinyl chloride, polyvinylidene chloride, polyvinyl alcohol, polyvinyl butyral, nylon, polyetheretherketone, polysulfone, polyethersulfone, tetrafluoroethylene/perfluoroalkyl vinyl ether copolymer, polyvinyl fluoride, tetrafluoroethylene/ethylene copolymer, tetrafluoroethylene/hexafluoropropylene copolymer, polychlorotrifluoroethylene, and polyvinylidene fluoride. Among them, transparent sheets may be used as the substrate of the thermal transfer image-receiving sheet for OHP applications. In the case of the standard type thermal transfer image-receiving sheet, it is possible to use, besides the above films, a white opaque film, prepared by adding a white pigment or a filler to the above synthetic resin and forming the mixture into a sheet, and a foamed sheet. Further, various types of papers, such as capacitor paper, glassine paper, parchment paper, synthetic papers (such as polyolefin and polystyrene papers), wood free paper, art paper, coat paper, cast coated paper, paper impregnated with a synthetic resin or an emulsion, paper impregnated with a synthetic rubber latex, paper with a synthetic resin internally added thereto, and cellulose fiber paper.

Furthermore, laminates of any combination of the above substrate sheets may also be used. Representative examples of the laminate include a laminate of cellulose fiber paper and synthetic paper and a laminate of cellulose fiber paper and a synthetic paper of a plastic film.

Furthermore, at least one side of the above substrate sheets may have been subjected to treatment for improving the adhesion.

Preferably, the substrate sheet has a surface resistivity of not more than $1.0\times10^{12}$ Ω□ under an environment of temperature 20° C. and relative humidity 50%. Such a substrate sheet may be selected from the above materials.

Alternatively, the materials may be subjected to antistatic treatment to bring the surface resistivity to the above value. The use of the substrate sheet having the above surface resistivity can prevent troubles caused by static electricity during the production of the image-receiving sheet and, at the same time, can enhance the effect of an antistatic agent, described below, coated on the image-receiving surface and/or the back surface of the thermal transfer image-receiving sheet.

The thickness of the substrate sheet is generally about 3 to 300 $\mu$m. It, however, is preferably 75 to 175 $\mu$m from the viewpoint of mechanical properties and other properties. If the substrate sheet has poor adhesion to a layer provided thereon, the surface thereof may be subjected to adhesiveness-improving treatment or corona discharge treatment.

<Image-receiving layer>

According to the thermal transfer image-receiving sheet of the present invention, the image-receiving layer comprises a copolymer, having an average degree of polymerization of 800 to 2000, of at least vinyl chloride and vinyl acetate as main comonomers.

Other monomers which may be used as other comonomer (s) than vinyl chloride and vinyl acetate as main comonomers constituting the copolymer include vinyl alcohol and vinyl alcohol derivatives, such as vinyl propionate; acrylic and methacrylic acid and derivatives thereof, such as methyl, ethyl, propyl, butyl, and 2-ethylhexyl esters of acrylic and methacrylic acids; maleic acid and derivatives thereof, such as diethyl maleate, dibutyl maleate, and dioctyl maleate; derivatives of vinyl ether, such as methyl vinyl ether, butyl vinyl ether, and 2-ethylhexyl vinyl ether; acrylonitrile; methacrylonitrile; and styrene. The contents of the vinyl chloride and vinyl acetate in the copolymer are not particularly limited. However, the content of vinyl chloride in the copolymer is preferably not less than 50% by weight. The content of the components other than vinyl chloride and vinyl acetate is preferably not more than 10% by weight.

The average degree of polymerization of the copolymer comprising the above comonomers should be 800 to 2000. In the case of vinyl chloride/vinyl acetate copolymers having an average degree of polymerization of less than 800, for example, the above commercially available vinyl chloride/vinyl acetate copolymers having an average degree of polymerization of 200 to 700, the image-receiving layer has poor resistance to roughening in the high-energy print area thereof or to scratch. On the other hand, copolymers having an average degree of polymerization exceeding 2000 have poor solubility in various solvents, and, hence, the solid content of a coating liquid cannot be made high, or the coating liquid becomes highly viscous, rendering the coating difficult.

In the thermal transfer image-receiving sheet according to the present invention, the image-receiving sheet may be formed of a mixture of the above vinyl chloride/vinyl acetate copolymer having a high degree of polymerization with other thermoplastic resin(s). Thermoplastic resins usable herein include polyolefin resins such as polypropylene; halogenated polymers such as polyvinyl chloride and polyvinylidene chloride; vinyl resins such as polyvinyl acetate, ethylene/vinyl acetate copolymer, and polyacrylic esters; polyester resins; polystyrene resins; polyamide resins; olefin/vinyl monomer copolymer resins; ionomers; cellulosic resins such as cellulose diacetate; polycarbonate resins; polyvinyl acetal resins; and polyvinyl alcohol resins. When the mixture of the vinyl chloride/vinyl acetate copolymer having a high degree of polymerization with the above resin is used, the content of the vinyl chloride/vinyl acetate copolymer having a high degree of polymerization in the mixture is not less than 50% by weight.

If necessary, various other additives may be added. For example, a release agent may be added so that the thermal transfer sheet and the thermal transfer image-receiving sheet are not heat-fused to each other at the time of printing. Reaction-curable silicones, such as vinyl-modified silicone, amino-modified silicone, and epoxy-modified silicone, may be mentioned as particularly preferred release agents. The amount of the release agent added is preferably 0.5 to 10% by weight based on the resin.

Further, a plasticizer may be added in order to improve the sensitivity of the image-receiving layer. Plasticizers usable herein include those commonly used in vinyl chloride resin, for example, monomeric plasticizers, such as phthalic esters, phosphoric esters, adipic esters, and sebacic esters, and polyester plasticizers prepared by polymerizing adipic acid or sebacic acid with propylene glycol. In general, the plasticizers listed above have a low molecular weight. In addition, special olefin copolymer resins as a high-molecular plasticizer for vinyl chloride may also be used. Resins usable herein include those commercially available under the trade name designations Elvaloy 741, Elvaloy 742, Elvaloy HP 443, Elvaloy HP 553, Elvaloy EP 4015, Elvaloy EP 4043, and Elvaloy EP 4051 (manufactured by Du Pont-Mitsui Polychemicals Co., Ltd.). The amount of the above plasticizer added may be up to about 100% by weight based on the resin. However, it is preferably not more than 30% by weight from the viewpoint of bleeding of the print.

Further, in order to impart an antistatic property, it is also possible to incorporate the following antistatic agent into a coating liquid for an image-receiving layer: fatty acid esters, sulfuric esters, phosphoric esters, amides, quaternary ammonium salts, betaine, amino acids, acrylic resins, ethylene oxide adducts and the like.

The amount of the antistatic agent added is preferably 0.1 to 2.0% by weight based on the resin.

The image-receiving layer may be formed by adding the above optional additives and the like to the above vinyl chloride/vinyl acetate copolymer as a main component, thoroughly kneading them in a solvent, a diluent or the like to prepare a coating liquid for an image-receiving layer, coating the coating liquid onto the above substrate sheet, for example, by gravure printing, screen printing, or reverse roll coating using a gravure plate, and drying the coating to form an image-receiving layer.

In the thermal transfer image-receiving sheet according to the present invention, the coating liquid for an image-receiving layer should preferably be coated at a coverage of 0.5 to 4.0 g/m$^2$ on a dry weight basis. When the coverage is less than 0.5 g/mg$^2$ on a dry weight basis, for example, when an image-receiving layer is provided directly on the substrate, the adhesion of the image-receiving layer to the thermal head is likely to be unsatisfactory due to the rigidity of the substrate or the like, posing a problem of harsh image in its highlight area. This problem can be avoided by providing an intermediate layer for imparting a cushioning property. This means, however, deteriorates the scratch resistance of the image-receiving layer.

There is a tendency that the surface roughening resistance of the image-receiving layer upon the application of high energy decreases relatively with increasing the coverage of the image-receiving layer. When the coverage exceeds 4.0 g/m$^2$ on a dry weight basis, the high-density area projected through OHP is sometimes slightly blackish.

<Intermediate layer>

In the thermal transfer image-receiving sheet according to the present invention, an intermediate layer formed of various resins may be provided between the substrate sheet and the image-receiving layer. Excellent functions may be added to the image-receiving sheet by imparting various properties to the intermediate layer.

For example, a resin having large elastic deformation or plastic deformation, for example, a polyolefin, vinyl copolymer, polyurethane, or polyamide resin, may be used as a resin for imparting a cushioning property in order to improve the sensitivity of the image-receiving sheet or to prevent harsh image. Further, when the intermediate layer is provided using a resin having a glass transition temperature of 60° C. or above or a resin which has been cured with a curing agent or the like, the adhesion between sheets can be prevented when a plurality of sheets of the image-receiving sheet are stored with the sheets being put on top of one another, thereby improving the storage stability of the image-receiving sheet.

When an antistatic property is imparted to the intermediate layer, the intermediate layer may be prepared by dissolving or dispersing the above resin, with an antistatic resin or a resin having an antistatic property added thereto, in a solvent and coating the solution or the dispersion to form an intermediate layer.

Antistatic agents usable herein include, for example, fatty acid esters, sulfuric esters, phosphoric esters, amides, quaternary ammonium salts, betaine, amino acids, acrylic resins, and ethylene oxide adducts.

Resins having an antistatic property usable herein include, for example, conductive resins prepared by introducing a group having an antistatic effect, such as a quaternary ammonium salt, phosphoric acid, ethosulfate, vinyl pyrrolidone, or sulfonic acid group, into a resin, such as an acrylic, vinyl, or cellulose resin, or alternatively by copolymerizing the above resin with the above group having an antistatic effect. A cation-modified acrylic resin is particularly preferred.

Preferably, the group having an antistatic effect is introduced in a pendant form into the resin from the viewpoint of introducing the group at a high density. Specific examples of commercially available antistatic resins include Jurymer series manufactured by Nihon Junyaku Co., Ltd., Reolex series manufactured by Dai-Ichi Kogyo Seiyaku Co., Ltd., and Elecond series manufactured by Soken Chemical Engineering Co., Ltd.

The intermediate layer may be formed by thoroughly kneading the above resin with optional additives in a solvent, a diluent or the like to prepare a coating liquid for an intermediate layer, coating the coating liquid onto the above substrate sheet by the same means as described above in connection with the formation of the image-receiving layer, that is, such as gravure printing, screen printing, or reverse roll coating using a gravure plate, and drying the coating to form an intermediate layer.

<Back side layer>

A back side layer may be provided on the back side of the substrate sheet for purposes of improvement in carriability of the thermal transfer image-receiving sheet, prevention of curling of the sheet, or other purposes. The back side layer having such a function may be formed of an acrylic resin with an organic filler, such as a fluororesin or a polyamide resin.

Preferably, the back side layer is formed of a composition containing an acrylic polyol and fine particles of an organic material.

Acrylic polyols usable herein include polymers, such as ethylene glycol methacrylate and propylene glycol methacrylate. Further, acrylic polyols wherein the ethylene glycol moiety is trimethylene glycol, butanediol, pentanediol, hexanediol, cyclopentanediol, cyclohexanediol, or glycerin may also be used. The acrylic polyol contributes to prevention of curling, can hold additives such as organic or inorganic fillers, and has good adhesion to the substrate.

More preferably, the back side layer is formed of a cured product prepared by curing an acrylic polyol with a curing agent. The curing agent may be a generally known one. Among others, the use of an isocyanate compound is preferred. The reaction of the acrylic polyol with an isocyanate compound results in the formation of a urethane bond to cure the acrylic polyol, thereby forming a stereostructure to improve the heat resistance, the storage stability, and the solvent resistance. Further, it can and to improve the adhesion of the back side layer to the substrate. The amount of the curing agent added is preferably 1 to 2 equivalents based on one reactive group equivalent of the resin.

Further, the addition of an organic filler to the back side layer is preferred. The filler functions to improve the carriability of the sheet within a printer and, at the same time, to prevent blocking or the like, thereby improving the storage stability of the sheet. Organic fillers usable herein include acrylic fillers, polyamide fillers, fluorofillers, and polyethylene wax. Among them, polyamide fillers are particularly preferred. Preferably, the polyamide filler has a molecular weight of 100,000 to 900,000 and are spherical with an average particle diameter of 0.01 to 10 $\mu$m. The polyamide filler has a high melting point, is stable against heat, has good oil resistance and chemical resistance, and is less likely to be dyed with a dye. Further, when the polyamide filler has a molecular weight of 100,000 to 900,000, it is hardly abraded, has a self-lubricating property and a low coefficient of friction, and is less likely to damage a counter material with which the back side layer is brought into friction. In the polyamide filler, nylon 12 filler is better than nylon 6 and nylon 66 fillers because it has superior water resistance and is free from any property change attributable to water absorption.

The amount of the filler added is preferably 0.05 to 200% by weight based on the resin. In this connection, it should be noted that, in the case of an image-receiving sheet, for OHP, wherein the addition of a filler deteriorates transparency of the sheet, the filler is added in an amount of not more than 2% by weight based on the resin, or a filler having a small particle diameter is selected.

The provision of the above back side layer can improve the scratch resistance of the image-receiving layer of the thermal transfer image-receiving sheet according to the present invention.

The back side layer may be prepared by thoroughly kneading the above resin with an organic filler in a solvent, a diluent or the like to prepare a coating liquid for a back side layer, coating the coating liquid onto the surface of the substrate sheet, remote from the image-receiving layer, by the same means as described above in connection with the formation of the image-receiving layer, that is, such as gravure printing, screen printing, or reverse roll coating using a gravure plate, and drying the coating to form a back side layer.

<Adhesive layer>

An adhesive layer formed of an adhesive resin, such as an acrylic ester resin, a polyurethane resin, or a polyester resin, may be provided on at least one side of the substrate sheet.

The adhesive layer may be prepared by preparing a coating liquid using the above resin, coating the coating liquid on at least one side of the substrate sheet, for example, by gravure printing, screen printing, or reverse roll coating using a gravure plate, and drying the coating to form an adhesive layer.

Alternatively, at least one side of the substrate sheet may be subjected to corona discharge treatment without providing the above coating, thereby enhancing the adhesion of the substrate sheet to a layer provided on the substrate sheet.

<Antistatic layer>An antistatic layer may be provided on at least one side of the substrate sheet, on the image-receiving surface or the back side of the image-receiving sheet, or on the outermost surface of each of both sides of the image-receiving sheet. The antistatic layer may be formed by dissolving or dispersing an antistatic agent, for example, a fatty acid ester, a sulfuric ester, a phosphoric ester, an amide, a quaternary ammonium salt, betaine, an amino acid, an acrylic resin, or an ethylene oxide adduct, in a solvent, coating the solution or dispersion, and drying the coating.

In this case, the dispersion or the solution may be coated, for example, by gravure printing, screen printing, or reverse roll coating using a gravure plate. The coverage is preferably 0.001 g/m$^2$ to 0.1 g/m$^2$ on a dry weight basis.

Since an image-receiving sheet having an antistatic layer on the outermost surface thereof has an antistatic property before printing, it can prevent feed troubles such as double feed. Further, troubles such as dropout caused by attraction of dust or the like can be prevented.

As described above, by virtue of the provision of an image-receiving layer, comprising a copolymer, having an average degree of polymerization of 800 to 2000, of at least vinyl chloride and vinyl acetate as main comonomers, the resin on the surface of the image-receiving layer is less likely to be roughened by heat applied by means of a thermal head at the time of high energy printing, preventing only a high density area from being matted or preventing the formation of a blackish projected image in the case of an image-receiving sheet for OHP.

Further, since the resin constituting the surface of the image-receiving sheet comprises a copolymer, having an average degree of polymerization of 800 to 2000, of at least vinyl chloride and vinyl acetate as main comonomers and is less likely to be subjected to elastic or plastic deformation, the image-receiving layer is less likely to be scratched.

The following examples further illustrate the present invention but are not intended to limit it. In the following examples and comparative examples, all "parts" or "%" are by weight unless otherwise specified.

EXAMPLE 1

A coating liquid, for an intermediate layer, having the following composition was coated on the following substrate A by gravure coating at a coverage on a dry basis of 0.7 g/m$^2$, and the coating was dried to form an intermediate layer. A coating liquid A, for an image-receiving layer, having the following composition was coated on the intermediate layer by roll coating at a coverage on a dry basis of 3.0 g/m$^2$, and the coating was dried to form an image-receiving layer. A coating liquid A, for a back side layer, having the following composition was then coated on the back side of the substrate remote from the image-receiving layer by roll coating at a coverage on a dry basis of 4.0 g/m$^2$, and the coating was dried to form a back side layer. Finally, a coating liquid, for an antistatic layer, having the following composition was coated on the image-receiving layer and on the back side layer by roll coating each at a coverage on a dry basis of 0.01 g/m$^2$, and the coatings were then dried to form an antistatic layer on each of the image-receiving layer and the back side layer, thereby preparing an image-receiving sheet of Example 1.

Substrate A

A 125 μm-thick transparent polyethylene terephthalate (PET) sheet both sides of which have been subjected to antistatic treatment (Lumirror U-94, manufactured by Toray Industries, Inc.)

| Coating liquid for intermediate layer | |
|---|---|
| Antistatic resin (cation-modified acrylic resin)(Elecond PQ-50B manufactured by Soken Chemical Engineering Co., Ltd.) | 10 parts |
| Toluene | 15 parts |
| Methyl ethyl ketone | 15 parts |
| **Coating liquid A for image-receiving layer** | |
| Vinyl chloride/vinyl acetate copolymer resin: degree of polymerization = 930 (vinyl chloride: 83%/vinyl acetate: 17%) | 100 parts |
| Vinyl-modified silicone: X-62-1212 (manufactured by Shin-Etsu Chemical Co., Ltd.) | 2 parts |
| Catalyst: PL-50T (manufactured by Shin-Etsu Chemical Co., Ltd.) | 1 part |
| Solvent: MEK/toluene = 1/1 (weight ratio) | 600 parts |
| **Coating liquid A for back side layer** | |
| Acrylic polyol resin: Acrydic 47-538 (manufactured by Dainippon Ink and Chemicals, Inc.) | 300 parts |
| Isocyanate curing agent: Takenate A-14 (manufactured by Takeda Chemical Industries, Ltd.) | 30 parts |
| Fine particles of polyamide: MW-330 (manufactured by Shinto Paint Co., Ltd.) | 1 part |
| Catalyst: S-CAT 24 (manufactured by Sankyo Organic Chemicals Co., Ltd.) | 1 part |
| Solvent: MEK/toluene/butyl acetate = 3/3/1 (weight ratio) | 700 parts |
| **Coating liquid for antistatic layer** | |
| Antistatic agent: TB-34 (manufactured by Matsumoto Yushi Seiyaku Co., Ltd.) | 0.1 part |
| Solvent: IPA | 200 parts |

EXAMPLE 2

An image-receiving sheet of Example 2 was prepared in the same manner as in Example 1, except that a coating liquid B, for an image-receiving layer, having the following composition was used instead of the coating liquid A for an image-receiving layer.

| Coating liquid B for image-receiving layer | |
|---|---|
| Vinyl chloride/vinyl acetate copolymer resin: degree of polymerization = 1500 (vinyl chloride: 75%/vinyl acetate: 25%) | 100 parts |
| Amino-modified silicone: KF-393 (manufactured by Shin-Etsu Chemical Co., Ltd.) | 1.5 parts |
| Epoxy-modified silicone: X-22-343 (manufactured by Shin-Etsu Chemical Co., Ltd.) | 1.5 parts |
| Solvent: MEK/toluene = 1/1 (weight ratio) | 600 parts |

EXAMPLE 3

An image-receiving sheet of Example 3 was prepared in the same manner as in Example 1, except that a coating liquid C, for an image-receiving layer, having the following composition was used instead of the coating liquid A for an image-receiving layer.

| Coating liquid C for image-receiving layer | |
|---|---|
| Vinyl chloride/vinyl acetate copolymer resin: degree of polymerization = 1200 (vinyl chloride: 90%/vinyl acetate: 3%/PVA: 7%) | 80 parts |
| Polyester resin: Vylon 600 (manufactured by Toyobo Co., Ltd.) | 20 parts |
| Vinyl-modified silicone: X-62-1212 (manufactured by Shin-Etsu Chemical Co., Ltd.) | 3 parts |
| Catalyst: PL-50T (manufactured by Shin-Etsu Chemical Co., Ltd.) | 1.5 parts |
| Solvent: MEK/toluene = 1/1 (weight ratio) | 600 parts |

EXAMPLE 4

An image-receiving sheet of Example 4 was prepared in the same manner as in Example 1, except that a coating liquid D, for an image-receiving layer, having the following composition was used instead of the coating liquid A for an image-receiving layer.

| Coating liquid D for image-receiving layer | |
|---|---|
| Vinyl chloride/vinyl acetate copolymer resin: degree of polymerization = 1050 (vinyl chloride: 85%/vinyl acetate: 14%/maleic acid: 1%) | 100 parts |
| Vinyl-modified silicone: X-62-1212 (manufactured by Shin-Etsu Chemical Co., Ltd.) | 3 parts |
| Catalyst: PL-50T (manufactured by Shin-Etsu Chemical Co., Ltd.) | 1.5 parts |
| Solvent: MEK/toluene = 1/1 (weight ratio) | 600 parts |

EXAMPLE 5

An image-receiving sheet of Example 5 was prepared in the same manner as in Example 1, except that a coating liquid E, for an image-receiving layer, having the following composition was used instead of the coating liquid A for an image-receiving layer.

| Coating liquid E for image-receiving layer | |
|---|---|
| Vinyl chloride/vinyl acetate copolymer resin: degree of polymerization = 930 (vinyl chloride: 83%/vinyl acetate: 17%) | 100 parts |
| Plasticizer: DOP | 12 Parts |
| Vinyl modified silicone: X-62-1212 (manufactured by Shin-Etsu Chemical Co., Ltd.) | 3 parts |
| Catalyst: PL-50T (manufactured by Shin-Etsu Chemical Co., Ltd.) | 1.5 parts |
| Solvent: MEK/toluene = 1/1 (weight ratio) | 600 parts |

-continued

EXAMPLE 6

An image-receiving sheet of Example 6 was prepared in the same manner as in Example 1, except that a coating liquid F, for an image-receiving layer, having the following composition was used instead of the coating liquid A for an image-receiving layer.

| Coating liquid F for image-receiving layer | |
|---|---|
| Vinyl chloride/vinyl acetate copolymer resin: degree of polymerization = 930 (vinyl chloride: 83%/vinyl acetate: 17%) | 100 parts |
| Polymeric plasticizer: Elvaloy 741 (manufactured by Du Pont-Mitsui Polychemicals Co., Ltd.) | 20 parts |
| Vinyl-modified silicone: X-62-1212 (manufactured by Shin-Etsu Chemical Co., Ltd.) | 2 parts |
| Catalyst: PL-50T (manufactured by Shin-Etsu Chemical Co., Ltd.) | 1 part |
| Solvent: MEK/toluene = 1/1 (weight ratio) | 600 parts |

EXAMPLE 7

An image-receiving sheet of Example 7 was prepared in the same manner as in Example 1, except that a coating liquid G, for an image-receiving layer, having the following composition was used instead of the coating liquid A for an image-receiving layer.

| Coating liquid G for image-receiving layer | |
|---|---|
| Vinyl chloride/vinyl acetate copolymer resin: degree of polymerization = 930 (vinyl chloride: 83%/vinyl acetate: 17%) | 70 parts |
| Vinyl chloride/vinyl acetate copolymer resin: degree of polymerization = 420 #1000 AKT (manufactured by Denki Kagaku Kogyo K.K.) (vinyl chloride: 83%/vinyl acetate: 17%) | 30 parts |
| Vinyl modified silicone: X-62-1212 (manufactured by Shin-Etsu Chemical Co., Ltd.) | 2 parts |
| Catalyst: PL-50T (manufactured by Shin-Etsu Chemical Co., Ltd.) | 1 part |
| Solvent: MEK/toluene = 1/1 (weight ratio) | 600 parts |

EXAMPLE 8

An image-receiving sheet of Example 8 was prepared in the same manner as in Example 1, except that the following substrate B was used instead of the substrate A.

Substrate B

A 100 $\mu$m-thick white PET sheet both sides of which have been subjected to antistatic treatment (Lumirror E-22, manufactured by Toray Industries, Inc.)

EXAMPLE 9

An image-receiving sheet of Example 9 was prepared in the same manner as in Example 6, except that the substrate B as used in Example 8 was used instead of the substrate A.

EXAMPLE 10

An image-receiving sheet of Example 10 was prepared in the same manner as in Example 1, except that a coating liquid B, for a back side layer, having the following composition was used instead of the coating liquid A for a back side layer.

| Coating liquid B for back side layer | |
|---|---|
| Acrylic resin: Dianal BR-85 (manufactured by Mitsubishi Rayon Co., Ltd.) | 200 parts |
| Fine particles of fluororesin: Ruburon L-5 (manufactured by Daikin Industries, Ltd.) | 1 part |
| Solvent: MEK/toluene = 1/1 (weight ratio) | 800 parts |

EXAMPLE 11

An image-receiving sheet of Example 11 was prepared in the same manner as in Example 1, except that the image-receiving layer was provided at a coverage on a dry weight basis of 5.0 g/m$^2$.

EXAMPLE 12

An image-receiving sheet of Example 12 was prepared in the same manner as in Example 7, except that the coating liquid B, for a back side layer, as used in Example 10 was used instead of the coating liquid A for a back side layer.

Comparative Example 1

An image-receiving sheet of Comparative Example 1 was prepared in the same manner as in Example 1, except that a coating liquid H, for an image-receiving layer, having the following composition was used instead of the coating liquid A for an image-receiving layer.

| Coating liquid H for image-receiving layer | |
|---|---|
| Vinyl chloride/vinyl acetate copolymer resin: degree of polymerization = 690 #1000 MT2 (manufactured by Denki Kagaku Kogyo K.K.) (vinyl chloride: 80%/vinyl acetate: 20%) | 100 parts |
| Vinyl modified silicone: X-62-1212 (manufactured by Shin-Etsu Chemical Co., Ltd.) | 2 parts |
| Catalyst: PL-50T (manufactured by Shin-Etsu Chemical Co., Ltd.) | 1 part |
| Solvent: MEK/toluene = 1/1 (weight ratio) | 600 parts |

Comparative Example 2

An image-receiving sheet of Comparative Example 2 was prepared in the same manner as in Example 1, except that a coating liquid H, for an image-receiving layer, having the following composition was used instead of the coating liquid A for an image-receiving layer.

| Coating liquid I for image-receiving layer | |
|---|---|
| Vinyl chloride/vinyl acetate copolymer resin: degree of polymerization = 420 #1000 AKT (manufactured by Denki Kagaku Kogyo K.K.) (vinyl chloride: 83%/vinyl acetate: 17%) | 100 parts |
| Vinyl modified silicone: X-62-1212 (manufactured by Shin-Etsu Chemical Co., Ltd.) | 2 parts |
| Catalyst: PL-50T (manufactured by Shin-Etsu Chemical Co., Ltd.) | 1 part |
| Solvent: MEK/toluene = 1/1 (weight ratio) | 600 parts |

Comparative Example 3

An image-receiving sheet of Comparative Example 3 was prepared in the same manner as in Comparative Example 1, except that the substrate B as used in Example 8 was used instead of the substrate A.

Comparative Example 4

An image-receiving sheet of Comparative Example 4 was prepared in the same manner as in Comparative Example 2, except that the substrate B as used in Example 8 was used instead of the substrate A.

Each of the thermal transfer image-receiving sheets prepared in the examples and the comparative examples and a commercially available sublimation thermal transfer sheet were put on top of the other so that the image-receiving layer faced the dye layer, and heating was carried out from the back side of the thermal transfer sheet by means of a thermal head.

Evaluation of roughening resistance of surface of image-receiving layer

A printer which is equipped with a 300-dpi thermal head and can conduct regulation of 256 gradations was provided. A 16-step pattern with equally divided 256 gradation values (ranging from 0 to 255) was prepared, using this printer, for each color of yellow, magenta, and cyan and black formed by overprinting three colors of yellow, magenta, and cyan. The printing was carried out under conditions of printing speed 10 ms/line and maximum applied thermal energy 0.65 mJ/dot in the 16th step image. The resistance to roughening was evaluated for the 16th step image of each color of yellow, magenta, and cyan and black formed by overprinting of three colors of yellow, magenta, and cyan. When the substrate used was transparent, the print was projected through OHP and the projected image was visually inspected for the darkening of the image. On the other hand, when the substrate used was white, the print was visually inspected for matting of the high-density area.

Evaluation criteria are as follows.

◎: Neither blackening nor matting of image observed for each color.

○: Blackening of image not observed in projection through OHP, although matting of image observed for only black formed by overprinting of the three colors.

Δ: Matting of image observed for each color, and slight blackening of image observed in projection through OHP.

x: Matting of image observed in the near 15th and 16th step images, and blacking of image observed in projection through OHP.

Evaluation of scratch resistance of image-receiving surface

A plurality of sheets for each thermal transfer image-receiving sheet prepared in the examples and the comparative examples were set in a sheet cassette and automatically fed one by one into a printer where halftone solid printing was performed thereon.

The plurality of sheets of the image-receiving sheet, which are put on top of one another within the sheet cassette, are fed one by one by means of a pickup roll into the printer. For example, when the plurality of sheets of the image-receiving sheet are set with the image-receiving surface downward, friction occurs between the image-receiving surface of the image-receiving sheet pressed by the pickup roll and the back side of the image-receiving sheet located beneath the pressed sheet, often causing the sheet in its portion in contact with the pickup roll to be scratched. The releasability of the scratched portion often becomes unsatisfactory, resulting in abnormal transfer. In the test, the sheets were visually inspected for scratch. Among the sheets put on top of one another, a sheet located at the uppermost position and a sheet located at the lowermost position were not evaluated. The evaluation criteria are as follows.

⊙: Scratch hardly observed by visual inspection.

○: Slight scratch, having no influence on projection of the image through OHP, observed by visual inspection.

Δ: No abnormal transfer observed despite the presence of scratch observable by visual inspection.

x: Scratch observed by visual inspection, and abnormal transfer observed in the scratched portion.

Results of evaluation

For the image-receiving sheets prepared in the examples and the comparative examples, the layer construction is shown in Table 1, and the results of evaluation are tabulated in Table 2.

TABLE 1

| | Image-receiving layer | Coverage ($g/m^2$) (dry weight basis) | Sub-strate | Back side layer |
|---|---|---|---|---|
| Example 1 | A | 3 | A | A |
| 2 | B | 3 | A | A |
| 3 | C | 3 | A | A |
| 4 | D | 3 | A | A |
| 5 | E | 3 | A | A |
| 6 | F | 3 | A | A |
| 7 | G | 3 | A | A |
| 8 | A | 3 | B | A |
| 9 | F | 3 | B | A |
| 10 | A | 3 | A | B |
| 11 | A | 5 | A | A |
| 12 | G | 3 | A | B |
| Comparative | | | | |
| Example 1 | H | 3 | A | A |
| 2 | I | 3 | A | A |
| 3 | H | 3 | B | A |
| 4 | I | 3 | B | A |

TABLE 2

| | Roughening resistance | Scratch resistance |
|---|---|---|
| Example 1 | ⊙ | ⊙ |
| 2 | ⊙ | ⊙ |
| 3 | ○ | ⊙ |
| 4 | ⊙ | ⊙ |
| 5 | ○ | ○ |
| 6 | ⊙ | ○ |

TABLE 2-continued

| | Roughening resistance | Scratch resistance |
|---|---|---|
| 7 | ○ | ⊙ |
| 8 | ⊙ | ⊙ |
| 9 | ⊙ | ○ |
| 10 | ⊙ | ○ |
| 11 | Δ | ⊙ |
| 12 | ○ | Δ |
| Comparative | | |
| Example 1 | Δ | Δ |
| 2 | x | x |
| 3 | Δ | Δ |
| 4 | x | x |

A comparison of the results of Examples 1 to 10 with those of Comparative Examples 3 to 6 reveals that the image-receiving layer using a vinyl chloride/vinyl acetate copolymer having a high degree of polymerization offered better roughening resistance and scratch resistance than the image-receiving layer using a vinyl chloride/vinyl acetate copolymer having a relatively low degree of polymerization. Further, a comparison of the results of Example 1 with those of Example 11 reveals that increasing the coverage of the image-receiving layer resulted in increased tendency of roughening. Furthermore, a comparison of the results of Example 7 with those of Example 12 reveals that the back side layer not containing a combination of an acrylic polyol with fine particles of an organic material had scratch resistance inferior to the back side layer containing an acrylic polyol in combination with fine particles of an organic material. Thus, it was found that not only the use of a vinyl chloride/vinyl acetate copolymer having a high degree of polymerization but also coating of the image-receiving layer at a coverage on a dry weight basis of 0.5 to 4 $g/m^2$ and the provision of a back side layer containing an acrylic polyol in combination with fine particles of an organic material are effective in providing an image-receiving layer having high resistance to roughening and scratch.

What is claimed is:

1. A thermal transfer image-receiving sheet comprising: a substrate sheet; and an image-receiving layer provided on one side of the substrate sheet, the image-receiving layer comprising a copolymer, having an average degree of polymerization of 930 to 2000, of at least vinyl chloride and vinyl acetate as main comonomers.

2. The thermal transfer image-receiving sheet according to claim 1, wherein the coverage of the image-receiving layer is 0.5 to 4.0 $g/m^2$ on a dry weight basis.

3. The thermal transfer image-receiving sheet according to claim 1, which further comprises a back side layer provided on the other side of the substrate sheet, the back side layer being formed of a composition comprising an acrylic polyol and fine particles of an organic material.

4. The thermal transfer image-receiving sheet according to claim 1, which further comprises an intermediate layer, having an antistatic property, between the substrate sheet and the image-receiving layer.

5. The thermal transfer image-receiving sheet according to claim 1, wherein the substrate sheet is a transparent sheet.

6. The thermal transfer image-receiving sheet according to claim 1, wherein at least one side of the substrate sheet has been subjected to adhesiveness-improving treatment or anti-static treatment.

* * * * *